US009618173B2

(12) United States Patent
Linz et al.

(10) Patent No.: US 9,618,173 B2
(45) Date of Patent: Apr. 11, 2017

(54) DEVICE FOR CREATING LIGHT EFFECTS

(71) Applicant: ARTEFFECT, Montreuil (FR)

(72) Inventors: Aurélien Linz, Nozay (FR); Simon Blatrix, Paris (FR)

(73) Assignee: ARTEFFECT, Montreuil (FR)

( * ) Notice: Subject to any disclaimer, the term of this patent is extended or adjusted under 35 U.S.C. 154(b) by 0 days.

(21) Appl. No.: 14/894,887

(22) PCT Filed: May 21, 2014

(86) PCT No.: PCT/EP2014/060482

§ 371 (c)(1),
(2) Date: Nov. 30, 2015

(87) PCT Pub. No.: WO2014/191287

PCT Pub. Date: Dec. 4, 2014

(65) Prior Publication Data

US 2016/0123549 A1 May 5, 2016

(30) Foreign Application Priority Data

May 31, 2013 (FR) ..... 13 55018

(51) Int. Cl.
*F21S 10/02* (2006.01)
*F21W 121/00* (2006.01)
(Continued)

(52) U.S. Cl.
CPC ..... *F21S 10/026* (2013.01); *F21W 2121/00* (2013.01); *F21Y 2101/00* (2013.01); *F21Y 2113/13* (2016.08); *F21Y 2115/10* (2016.08)

(58) Field of Classification Search
CPC ..... A63J 5/025; F21S 10/00; F21S 10/026; F21S 10/06; F21S 10/063; F21V 3/00;
(Continued)

(56) References Cited

U.S. PATENT DOCUMENTS 1,747,556 A * 2/1930 Price ..... F21S 10/06 362/232
5,315,428 A * 5/1994 Peng ..... G06K 7/10693 250/233

(Continued)

FOREIGN PATENT DOCUMENTS

EP 2589861 A2 5/2013
FR 2591152 A1 6/1987

OTHER PUBLICATIONS

French Search Report from French Patent Application No. 1355018, dated Nov. 28, 2013.

(Continued)

*Primary Examiner* — Hargobind S Sawhney
(74) *Attorney, Agent, or Firm* — Greer, Burns & Crain, Ltd.

(57) ABSTRACT

A light device is provided, including: at least one source arranged to emit a light beam; an optical system arranged to send each light beam from a central zone in several possible directions contained in a light cone, the vertex of which is located in the central zone, such that each light beam propagates in its light cone; and a reflector system arranged to receive each light beam propagating in its light cone and to reflect each received light beam in a space and outside its light cone.

12 Claims, 3 Drawing Sheets

(51) Int. Cl.
*F21Y 101/00* (2016.01)
*F21Y 115/10* (2016.01)
*F21Y 113/13* (2016.01)

(58) Field of Classification Search
CPC ..... F21V 5/007; F21V 5/06; F21V 7/0016; F21V 7/0025; F21V 7/0083; F21V 14/04; F21V 14/06; F21V 7/00; F21W 2121/00; F21Y 2101/02; F21Y 2105/003; F21Y 2113/005; F21Y 2103/10; F21Y 2105/10; G02B 26/123; G02B 5/09; G09F 19/16; H01L 33/58; G06K 7/10693; G06K 7/10631
See application file for complete search history.

(56) References Cited

U.S. PATENT DOCUMENTS

| | | | | |
|---|---|---|---|---|
| 6,139,160 | A * | 10/2000 | Frucht | A47F 11/04 359/599 |
| 2003/0193654 | A1 | 10/2003 | Ushinski | |
| 2007/0014109 | A1* | 1/2007 | Pan | F21S 10/02 362/231 |
| 2009/0153928 | A1* | 6/2009 | Desaulniers | G02B 26/10 359/17 |
| 2011/0032698 | A1* | 2/2011 | Kim | F21V 7/0008 362/235 |

OTHER PUBLICATIONS

International Search Report from International Patent Application No. PCT/EP2014/060482, dated Sep. 4, 2014.

* cited by examiner

DEVICE FOR CREATING LIGHT EFFECTS

BACKGROUND

The present invention relates to a light device that makes it possible to create light effects.

Such a device enables a user to create a dynamic lighting ambience. The field of the invention is more particularly that of dynamic light effects, for example in a discotheque, for decoration or for events.

Patent FR 2 591 152 is known to describe a device that makes it possible to create light effects inside smoke trapped in an enclosed space.

The light effects are mainly due to the movement of the smoke interacting with light projectors, for example through cooling of the smoke, heating of the smoke or fanning, in order to create an animation "like a cloudy sky changing its appearance through wind and sunlight".

The main drawbacks of such a device according to the prior art are as follows:

- the dynamics of the light effects are relatively slow,
- the light effects created lack sharpness,
- there is only a small variety of possible light effects, and
- it does not enable satisfactory control and repeatability of the light effects created, as they are random (Brownian movement of smoke particles and/or smoke flow with turbulence).

The object of the invention is to propose a device that makes it possible to overcome at least one of these drawbacks.

SUMMARY

This aim is achieved with a light device comprising:

- at least one source arranged to emit a light beam,
- an optical system arranged to send each light beam from a central zone in several possible directions contained in a light cone the vertex of which is located in the central zone, such that each light beam propagates in its light cone,
- preferably an enclosed space (which may or may not form part of the device according to the invention), said enclosed space:
  - containing suspended elements arranged to diffuse the light of each light beam, or
  - being equipped with an injector arranged to inject into the enclosed space suspended elements arranged to diffuse the light of each light beam,
- a reflector system arranged to receive each light beam propagating in its light cone and to reflect into a space each received light beam (preferably into the optional enclosed space above), said reflector system preferably being arranged to move between several positions such that a change of position changes the trajectory of a light beam reflected by the reflector system,
- in the event that said reflector system is arranged to move between several positions, a control system arranged to move the reflector system between its positions.

The at least one source preferably comprises several sources. The light beam generated by each source has preferably a colour different from the colours of the other light beams.

The vertex of the light cone of each light beam forms a solid angle with a value comprised between 0 steradians not inclusive and $2\pi$ steradians inclusive, i.e. in the range $]0; 2\pi]$ steradians.

The vertex of the light cone of at least one light beam (preferably each light beam) forms a solid angle with a value equal to $2\pi$ steradians, i.e. the light cone is a light plane.

Each source preferably comprises a laser or a light-emitting diode or any other suitable light source.

The optical system can comprise a reflective surface mounted rotatably in the central zone about an axis, this reflective surface preferably being arranged to reflect each light beam such that after reflection by the reflective surface, each light beam propagates in its light cone in a direction that preferably depends on an angular position of the reflective surface about its axis.

The device according to the invention can comprise control means (typically consisting of the control system, in the event that said reflector system is arranged to move between several positions) that are preferably arranged to control rotation of the reflective surface about its axis at a constant rotation speed.

The device according to the invention can comprise control means (typically consisting of the control system, in the event that said reflector system is arranged to move between several positions) that are preferably arranged to control rotation of the reflective surface about is axis at a rotation speed greater than a speed threshold, such that each source only emits its light beam when the reflective surface has reached a rotation speed greater than this speed threshold.

The reflective surface can be mounted on a plate, such that the reflective surface is located between the plate and a space (separate from the space in which each light beam received by the reflector system is reflected, i.e. separate from the optional enclosed space above) containing the sources. The plate is preferably fixed to the device by several legs.

in the event that said reflector system is arranged to move between several positions, the reflector system can take the form of a polygon with several sides, each of its sides being formed by at least one mirror mounted rotatably about an axis (said axis preferably being parallel to the light plane of each light beam if the cones of light are planes).

In the event that the two previous conditions are met, each leg can be aligned (in the light plane of each light beam in the event that the cones of light are planes) with the central zone and a connecting corner between two sides of the polygon.

In the event that said reflector system is arranged to move between several positions, the reflector system can be mounted translatably (preferably perpendicular to the light plane of each light beam in the event that the light cones are planes).

The enclosed space is preferably delimited at least partially by transparent walls.

BRIEF DESCRIPTION OF THE DRAWINGS

Further advantages and features of the invention will become apparent on reading the detailed description of embodiments and applications, which are in no way limitative, and the attached drawings, in which.

Figure 1:
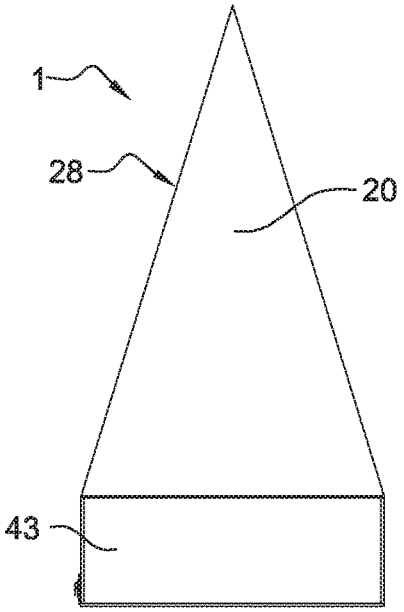
FIG. 1 is a general side view of a first embodiment of the device according to the invention, which is the preferred embodiment of the invention.

The dimensions given in the Figures are in millimeters.

DETAILED DESCRIPTION

As these embodiments are in no way limitative, variants of the invention can be envisaged that comprise only a selection of the features described below in isolation from the other features described (even if this selection is isolated within a sentence containing these other features), if this selection of features is sufficient to confer a technical advantage or to distinguish the invention from the prior art. This selection comprises at least one (preferably functional) feature without structural details, or with only a part of the structural details if this part alone is sufficient to provide a technical advantage or to distinguish the invention from the prior art.

A first embodiment of a light device 1 according to the invention for generating light effects will firstly be described, with reference to FIGS. 1 to 5.

The light device 1 comprises, in a space 43, at least one source arranged to emit a light beam specific to this source.

The at least one source comprises several sources 2, 3, 4, the light beam generated by each source having a colour different from the colours of the other light beams. By "colour" of a light beam is meant the wavelength of this light beam having the maximum intensity and being comprised between 400 nanometers and 800 nanometers (this wavelength also being known as the "main wavelength" of this light beam).

Each source 2, 3, 4 comprises a laser or a light-emitting diode. In the variant illustrated in the figures, each source 2, 3, 4 comprises a laser.

The at least one source comprises at least three sources, including a source 4 arranged to generate a red light beam (laser with a main wavelength of 650 nm, power 500 mW, made by CNI, reference MxL-III-655), a source 2 arranged to generate a green light beam (laser with a main wavelength of 532 nm, power 200 mW, made by CNI, reference MxL-III-532), and a source 3 arranged to generate a blue light beam (laser with a main wavelength of 447 nm, power 500 mW, made by CNI, reference PGL-V-H-447). Light effects of any colour can thus be created by superimposing these three beams, which form an RGB (red, green, blue) reference system.

The device 1 also comprises means (typically dichroic cubes 5, 6, 7) of superimposing and guiding, to an optical system 8, the optical paths of the light beams emitted by all of the sources 2, 3, 4.

The optical system 8 is arranged to send each light beam from a central zone 9 (more precisely, from a reflective surface 10 (located in this central zone 9) reflecting at 90° from a 3 mm reflective half-cube 11 made by Edmund Optics, reference 49405) in several possible directions 12 to 18 contained in a plane 19 (referred to as the "light plane" for clarity of identification) specific to this beam such that each light beam propagates in its light plane.

The light plane of each light beam is preferably horizontal. The light planes of the different light beams are preferably parallel to each other. In the specific case of the embodiment illustrated in FIGS. 1 to 5, the light planes of the different light beams are superimposed (the light plane 19 is therefore common to the light beams from all of the sources 2, 3, 4), as these different beams are all superimposed when they reach the surface 10 (however, in a variant in which the light beams are not superimposed before reaching the surface 10, there would be a separate light plane per light beam and therefore per source 2, 3, 4).

The optical system 8 comprises the reflective surface 10 of the cube 11. This reflective surface 10 is mounted rotatably in the central zone 9 about an axis 24 (preferably perpendicular to the light plane of each light beam), this rotation being activated by a motor 25. This reflective surface 10 is arranged to reflect each light beam such that after reflection by the reflective surface 10, each light beam propagates in its light plane 19 in a direction 12 to 18 that depends on an angular position of the reflective surface 10 about its axis 24.

The optical system 8 is arranged so that this direction 12 to 18 of a light beam explores all of the orientations 360 degrees around the central zone 9 (i.e. about the reflective surface 10 or about the axis 24) when the reflective surface 10 performs a complete rotation about its axis 24 and this light beam is emitted by its source during said complete rotation.

The reflective surface 10 is mounted on a plate 26 such that the surface 10 is located between the plate 26 and the space 43. The plate 26 is located between the motor 25 and the reflective surface 10. The plate is typically an aluminium plate.

This plate is a safety device so that an observer cannot view the cube 11 or the reflective surface 10 directly in order to prevent damage to the eyes.

Figure 4:
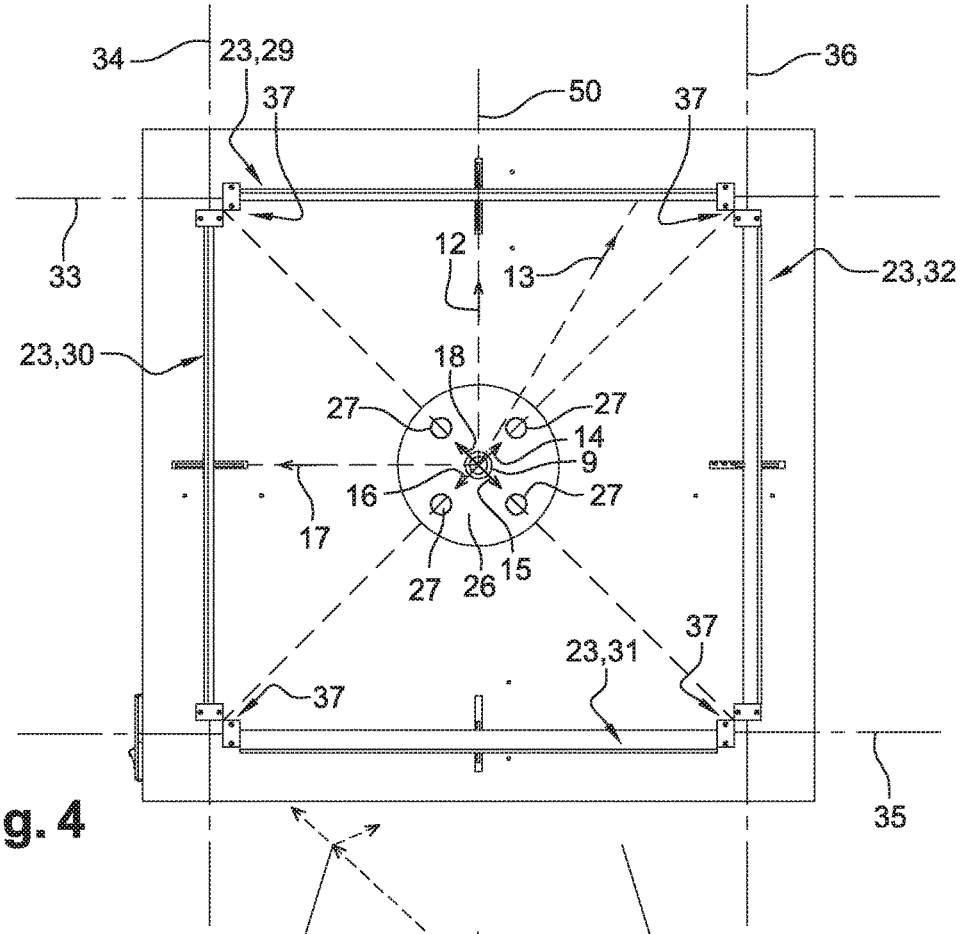
FIG. 4 is a cross-sectional top view of the enclosed space 20 of the device in FIG. 1.

The plate 26 is fixed to the device 1 by several legs 27. In FIG. 4, the outline of each leg 27 is illustrated for location purposes, whereas in reality in FIG. 4, the legs 27 are hidden by the plate 26.

Each leg 27 is arranged to fix the plate 26 to a plate 56 separating the space 20 from the space 43.

Inside or around the periphery of at least one of the legs 27, the device 1 comprises electrical wires arranged to power the motor 25 (originating from the space 43).

The device 1 also comprises an enclosed space 20 separate from the space 43.

The enclosed space 20 is delimited at least partially by transparent walls 28.

Each transparent wall 28 is arranged so that it has a transmission factor of the main wavelength of each light beam emitted by the sources 2, 3 and 4 of at least 20% (preferably at least 50%).

Each transparent wall 28 is a semi-transparent wall. Each transparent wall 28 is arranged so that it has a reflection factor of the main wavelength of each light beam emitted by the sources 2, 3 and 4 comprised between 50% and 80%.

The walls 28 are for example made from Plexiglas, glass or crystal.

In the example illustrated in the figures, the walls 28 are four triangular walls forming a pyramid 810 mm high, with a 500 mm×500 mm square base. Obviously, in other embodiments, these walls can form any shape of enclosed space 20 (cube, sphere, etc.: the shape of the enclosed space is infinitely adjustable; this makes it possible to adapt to the design of any location, and the colour of the enclosed space 20 can also be changed, as can the size thereof, so that very large-scale events and locations can be envisaged).

The device 1 also comprises an injector 21 arranged to inject into the enclosed space 20 (via a tube 22 opening into the enclosed space 20), suspended elements arranged to diffuse the light of each light beam. The suspended elements include for example smoke, droplets (for example droplets of water) or an aerosol.

The built-in aerosol system 21 and the enclosed space 20 make it possible to have suspended aerosol in the device 1 at all times. The 3D light shapes inside the enclosed space 20 will therefore be visible at all times wherever the device 1 is displayed.

The injector 21 is an aerosol generator, comprising a cylinder containing a liquid connected to two electrodes, that generates smoke when the electrodes are subject to a voltage. The injector 21 is for example produced by Seuthe, reference 430-500.

The device 1 also comprises a reflector system 23 arranged to receive each light beam originating from the optical system 8 propagating in its light plane 19 and to reflect in the enclosed space 20 (and outside of its light plane) each light beam received (i.e. to send each light beam received back inside the enclosed space 20).

The reflector system 23 has a reflectance of the main wavelength of each light beam emitted by the sources 2, 3 and 4 of at least 50%, preferably at least 90%.

The reflector system 23 is arranged to move between several positions such that a change of position of the reflector system 23 changes the trajectory of a light beam reflected by the reflector system 23.

The reflector system 23 is in the form of a polygon centred on the central zone 9 (and therefore on the reflective surface 10) and having several sides 29, 30, 31, 32, each of its sides 29 to 32 being formed by at least one mirror mounted rotatably about an axis 33 to 36 respectively, preferably parallel to the light plane 19 of each light beam. In the figures, each mirror has a rectangular shape 355 mm by 30 mm.

The rotation of one of the mirrors 29 to 32 of the reflector system 23 corresponds to a change of position of the reflector system 23.

It will be noted in FIG. 4 that, in the light plane 19 of each light beam, each leg 27 is aligned with the central zone 9 (i.e. with the reflective surface 10) and a connecting corner 37 between two sides 29 and 30, or 30 and 31, or 31 and 32, or 32 and 29 of the polygon. This makes it possible to limit, in the light plane 19 of each of the light beams emitted by the sources 2, 3, 4, the dead zones of said light beams.

The device 1 also comprises an electronic control system 38 arranged to move the reflector system 23 between its positions.

This control system 38 typically comprises a servomotor 41 (for example made by Hitec, reference HS-311) per mirror of the reflector system 23.

The control system 38 comprises:

a driver 52 for the source 2, a driver 53 for the source 3, and a driver 54 for the source 4.

The control system 38 comprises a printed circuit 44.

The printed circuit 44 makes it possible to connect all of the following parts of the control system 38 to each other: 21, 41, 52, 53, 54, 8, 38, 45, infrared detector.

The control system 38 comprises a microcontroller 42 reference Mega 2560 based on an ATmega2560 processor made by Arduino. The microcontroller 42 is connected to the sources 2 to 4 (by means of the drivers 52 to 54), the injector 21, the optical system 8, the servomotors 41, and to a computer via a USB port 46.

The control system 38 is also arranged to control when each of the sources 2, 3, 4 emits its light beam, given that each of the sources 2, 3, 4 is arranged to emit its light beam both continuously and intermittently. The light effects created by the device 1 can be given different shapes depending on the moment at which a given source 2, 3 or 4 emits its light beam. For example, the effects can be changed from a continuous figure to an intermittent figure made up of bars; and the colour, thickness and movement (direction of rotation, speed, etc.) of the bars can also be chosen.

In particular, the printed circuit 44 makes it possible to transmit the control signals originating from the microcontroller 42 to the servomotors 41, the smoke machine 21, the drivers 52 to 54 and the motor 25.

The signals sent to the drivers 52 to 54 are processed by the printed circuit 44.

The printed circuit 44 mainly contains two separate safety systems. The first is managed by the microcontroller 42 using an infrared sensor and an infrared receiver arranged to measure the rotation speed and/or angular position of the surface 10 in real time: in this way, if the speed becomes too low (below the speed threshold), the sources 2, 3, 4 are automatically switched off, and the safety of the device 1 is thus improved.

The second safety system, unlike the first, does not go through the microcontroller 42 (to allow for the failure of or a bug in the microcontroller 42): a condition relating to the voltage and current at the terminals of the motor 25 is determined to ensure a threshold speed and the satisfactory operation of the components of the circuit. The second safety system is arranged so that, in the event that this condition is not met, the sources 2 to 4 do not emit any light (more precisely, no power is supplied to the drivers 52 to 54).

In addition to reporting the rotation speed, the infrared sensor also reports the position of the rotating reflective surface 10 (angular position). As it has been seen, modulating the laser sources makes it possible to produce "bars" of light, the number of which varies depending on the ratio between the frequency of the square signal sent for modulation and the rotation speed. If the angular position in the plane 360° around the central zone 9 is known, the position of the "bars" created can be controlled precisely.

The control system 38 is also arranged to control a rotation of the reflective surface 10 about its axis 24 at a constant rotation speed (or "sweep rate"), (or at least within a small range of values typically 5% more or less than an average value over time) typically equal to 19,000 revolutions per minute, and greater than a speed threshold (this speed threshold being greater than 25 revolutions per second, so that it is greater than retinal persistence, and even greater than 160 revolutions per second, so that it is at a level below MPE (Maximum Permissible Exposure)) such that each source 2, 3, 4 only emits its light beam when the reflective surface 10 has reached this constant speed to within plus or minus 5% (or has reached a rotation speed greater than this speed threshold). A safety system using a sensor and an infrared receiver connected to the control system 38 makes it possible to know the rotation speed in real time: thus, if the speed becomes too low (below the speed threshold), the sources 2, 3, 4 are automatically switched off, and the safety of the device 1 is thus improved. Furthermore, by giving preference to a constant speed, speed "dead spots" are avoided, and the dynamism of the light effects is considerably improved. Furthermore, the quality of the light effects is improved over the prior art with laser effects using scanners. This prior art technology only sweeps a restricted solid angle, and when the beam reaches the limit of this solid angle, it has to turn back on itself, this U-turn involves (in order to comply with maximum power flux safety standards (known as MPE, Maximum Permissible Exposure) depending on the power of the laser, angular sweep rate, distance, waist size and divergence) a reduction in the intensity of the laser and therefore a deterioration in the quality of the light effects.

It will be noted that the sources 2, 3, 4, the superimposing and guiding means 5, 6, 7, the control system 38 and the injector 21 are located outside the enclosed space 20 (they are preferably in the other space 43 delimited by opaque walls, typically made from aluminium or wood), whereas the optical system 8 (including the cube 11, its reflective surface 10, the motor 25, the plate 26 and the legs 27) and the reflector system 23 are in the enclosed space 20.

According to the invention, to create light effects, the light moves, but the movement of the suspended elements (for example, smoke) is of little importance. This enables both great dynamism of the light effects created and high repeatability.

Above a rotation speed ω0 of the optical system 8 about its axis 24, retinal persistence will give the spectator the impression of seeing an light surface the shape of which will vary depending on the moment when each of the sources 2, 3, 4 emits its beam; the shape of the light surface, initially contained in the light plane 19 of this beam, is changed by reflection on the reflector system 23, which brings the beam and therefore the "light surface" outside the light plane 19 of the beam. In this case, the optical system 8 therefore converts each light beam into a first portion of "light surface" along its light plane 19 inside the enclosed space 20, then this light surface is deployed inside the enclosed space 20 in a second portion outside the light plane of the beam after having been reflected by the reflector system 23.

By means of the control system 38, it is thus possible to change the light surfaces in real time and create light choreography by moving the mirrors of the reflector system 23 using the servomotors 41, acting on the optical system 8, the modulation and power of the sources 2, 3, 4 and the smoke injector 21.

The aerosol injector 21 is arranged to fill the enclosed space 20 with smoke. The light entering the enclosed space 20 interacts with this smoke. This light is diffused in all the directions of the space and makes the different light surfaces visible.

The control system 38 makes it possible to influence each element of the optical chain and therefore change the nature of the light surface in real time. This makes it possible for the user to create an infinite number of different mathematical surfaces inside the device 1.

The light shapes can be extended outside the enclosed space 20 by passing through (reference 39) the walls 28 and creating an light animation 360° around the device 1. As the enclosed space 20 is visible through the transparent walls 28, the extension of the light surface thus created will also be visible outside the device 1. The spectator can linger both on the behaviour of the light surface inside the enclosed space 20 and on the lighting and light effects produced outside it. The device 1 is therefore simultaneously an object of attention and decoration and a light show making it possible to animate an entire room through 360°. The device 1 therefore makes it possible to provide illumination in all directions almost simultaneously from a central zone 9. This makes it possible for a user to use the device 1 as a central light, i.e. to position it in the middle of a room.

In addition, the light is reflected (reference 40) on the walls 28, which once again results in a modification of the light surface and consequently in additional visual effects on the walls 28 of the enclosed space 20.

The device 1 also comprises a switching mode power supply 45 that powers all of the elements of the device 1 that require electricity. This switching mode power supply 45 is itself supplied with 220 volts, the device 1 being arranged for connection to the mains at 220 V via the connection interface 46 that also holds the USB port.

Of course, the invention is not limited to the examples which have just been described and numerous adjustments can be made to these examples without exceeding the scope of the invention.

In particular, different variants that can be combined with each other can be envisaged, and are described below solely in terms of their differences compared with the embodiment described above.

In a first variant, the injector 21 can be absent. In this case, the enclosed space 20 is sealed and contains, almost permanently, suspended elements arranged to diffuse the light of each light beam.

In a second variant, the reflective surface 10 of a cube 11 mounted rotatably is replaced by a reflective surface 10 of a fixed conical mirror. Thus, the optical system 8 comprises a conical mirror located in the central zone 9, this conical mirror having a fixed reflective surface 10 in the central zone 9, this reflective surface 10 having as its axis of rotation symmetry the axis 24 perpendicular to the light plane 19 of each of the light beams, this reflective surface 10 being arranged to reflect each light beam such that after reflection by this reflective surface 10, each light beam propagates in its light plane in all of the directions 360° around this axis 24.

In a third variant, the reflector system 23 can comprise at least one mirror (and therefore at least one servomotor 41) per separate light plane 19, if light planes 19 of the beams emitted by the sources 2, 3, 4 are separate. In the particular case in which the reflector system 23 defines a polygon, the reflector system 23 can comprise at least one mirror (and therefore at least one servomotor 41) per separate light plane 19 and per side 29 to 32 of the polygon (a total of twelve mirrors in the case of a square with three sources emitting beams with three separate light planes).

In a fourth variant, the reflector system 23 comprises at least one mirror which, instead of being mounted rotatably as described above, is mounted translatably oblique or preferably perpendicular to the light plane 19 of each light beam. Preferably, it is then possible for the reflector system 23 to comprise only:

- a single mirror only, in the form of a closed loop (and therefore a single servomotor 41) for all of the beams from the sources 2, 3, 4, if the light planes 19 of the beams from the sources 2, 3, 4 are merged, or
- a single mirror in the form of a closed loop (and therefore a single servomotor 41) per separate light plane 19, if the light planes 19 of the beams emitted by the sources 2, 3, 4 are separate (a total of three mirrors if there are three sources emitting beams with three separate light planes), which makes it possible to have mirrors defining closed loops with shapes of varying complexity such as to create very varied, innovative light effects.

In a fifth variant, the walls 28 can be opaque. These walls 28 can for example be the walls of a room in a discotheque.

Figure 5:
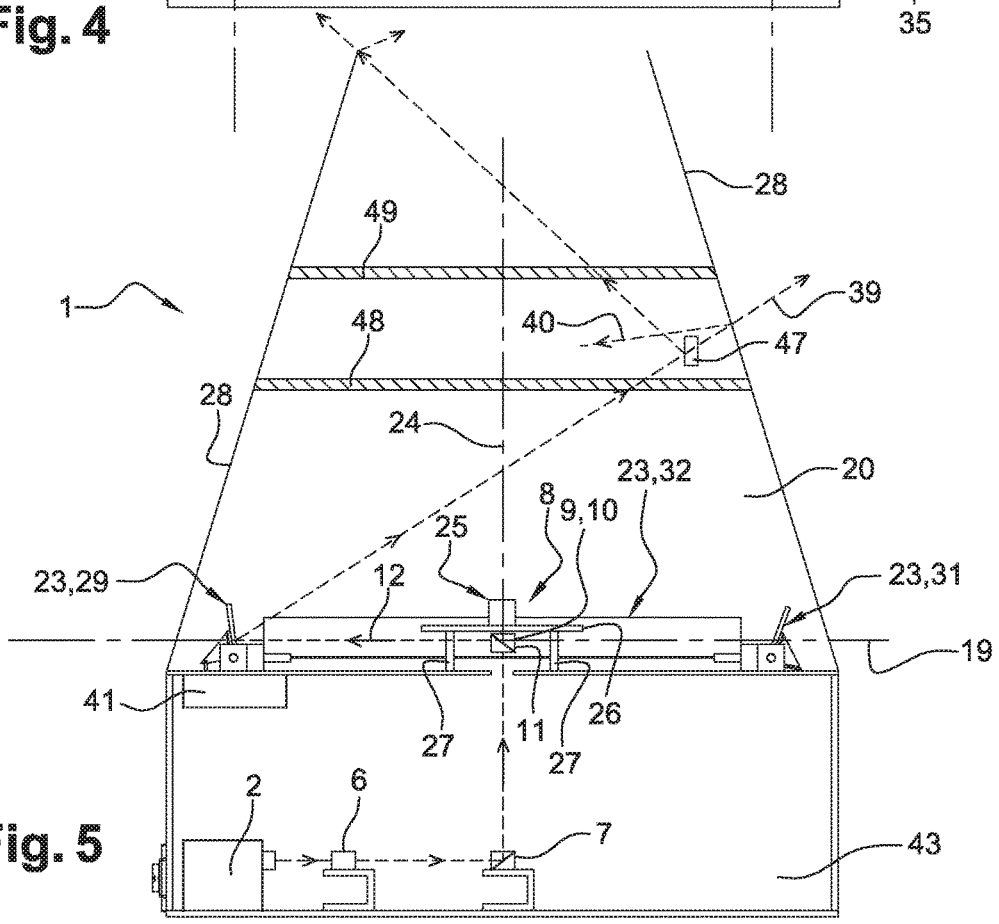
FIG. 5 is a cross-sectional side view of the device in FIG. 1 (including options referenced 47, 48, 49), along the cross-sectional line 50 in FIGS. 2 and 4.

In a sixth variant, as illustrated in FIG. 5, the device 1 can also comprise in the enclosed space 20 other optical elements 47 arranged to diffuse and/or reflect and/or diffract a light beam in the enclosed space 20 after it has been reflected by the reflector system 23, in order to add light effects, such as for example:

a reflective object (for example a sphere) that disperses the beam within the enclosed space 20, and/or reflective strips placed on the walls 28, and/or diffraction gratings, and/or transparent threads stretched across the enclosed space 20.

In a seventh variant, as illustrated in FIG. 5, the device 1 can also comprise an opaque wall (reference 48 where there is no other optical element 47 or reference 49 where there is another optical element 47), arranged to block each light beam emitted by the sources 2, 3, 4 and thus preventing their exit outside the device 1. This increases safety, particularly if the sources 2, 3, 4 are very powerful.

Figure 6:
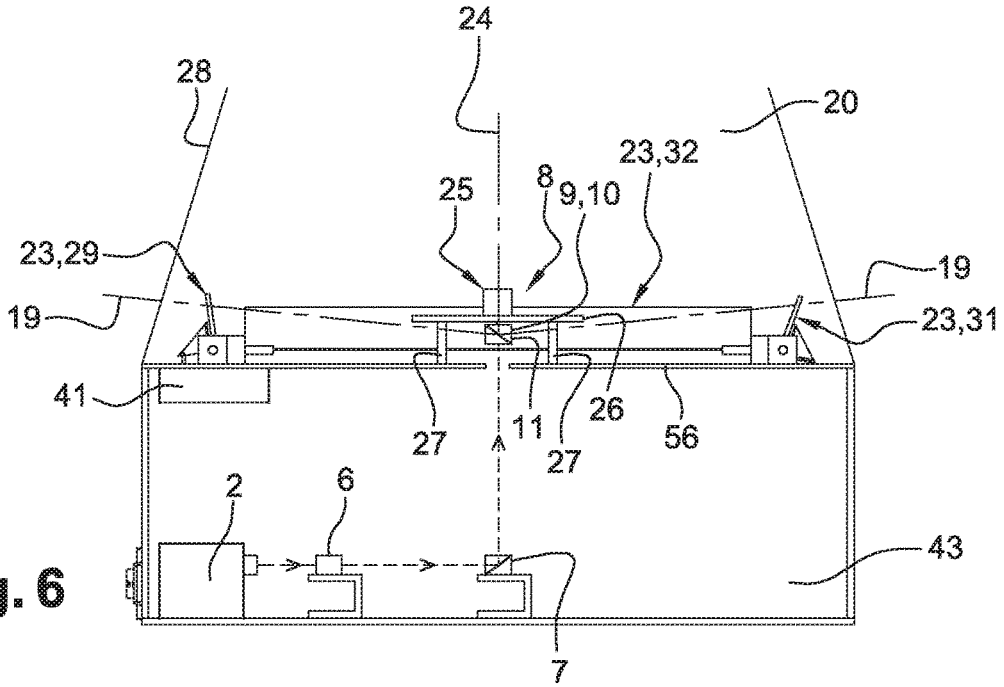
FIG. 6 is a cross-sectional side view of part of a variant of the device in FIG. 1.

In an eighth variant, depending on the slope of the reflective surface 10, and as illustrated in FIG. 6, the optical system 8 is arranged to send each light beam from the central zone 9 in several possible directions contained in a light cone 19 the vertex (located on the reflective surface 10) of which is located in the central zone 9. The technical description above with reference to the figures thus remains valid by replacing the word "plane" (or "light plane", reference 19) by the word "cone" (or "light cone").

Figure 7:
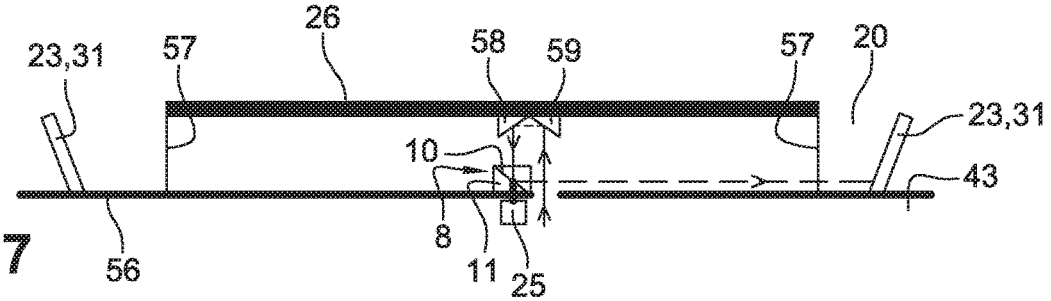
FIG. 7 is a cross-sectional side view of part of another variant of the device in FIG. 1.
Figure 2:
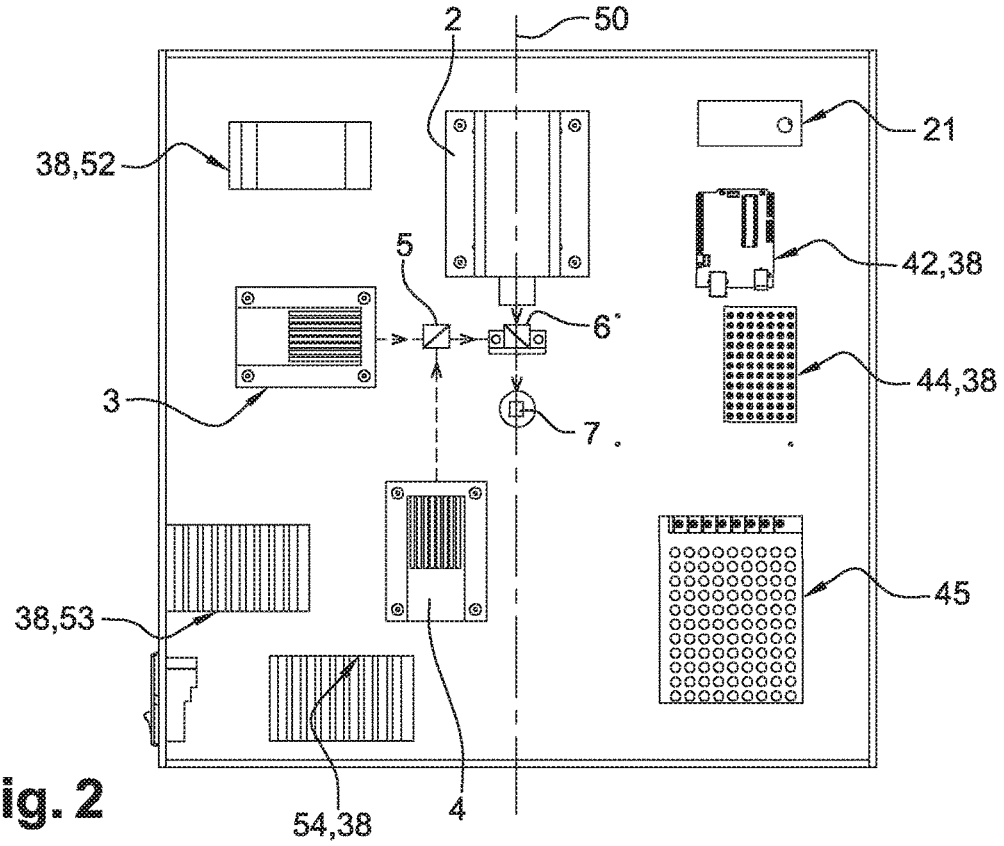
FIG. 2 is a cross-sectional top view of the space 43 of the device in FIG. 1.
Figure 3:
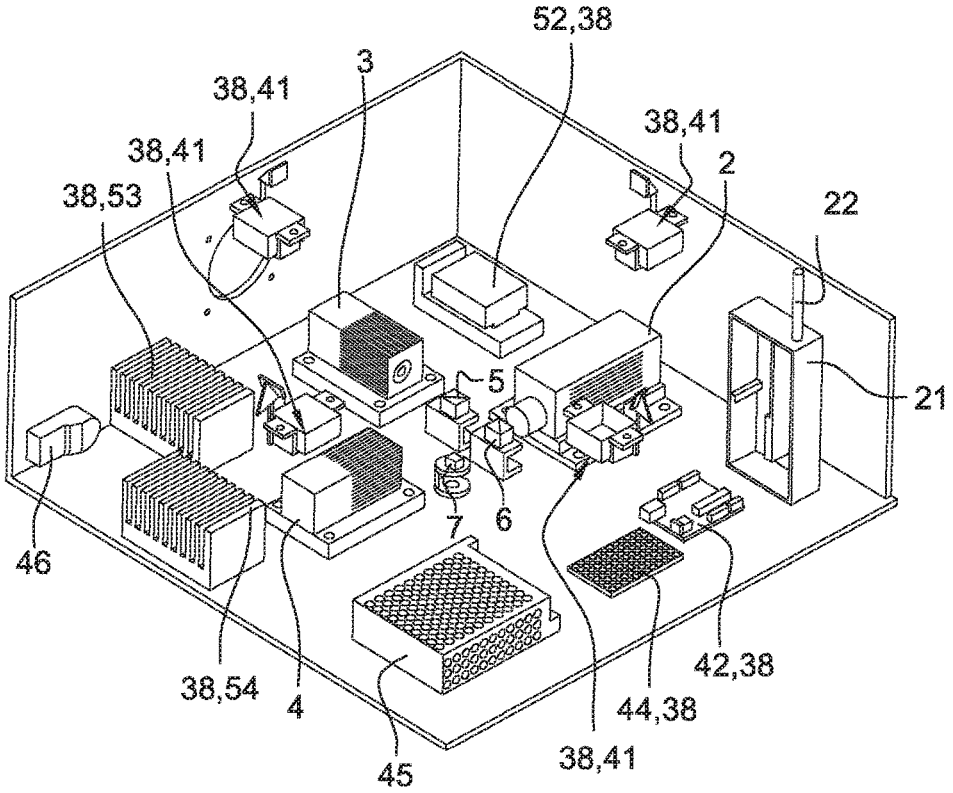
FIG. 3 is a perspective view of the inside of the space 43 of the device in FIG. 1.

In a ninth variant, and as illustrated in FIG. 7, the reflective surface 10 (more precisely typically the motor 25 making this surface 10 rotate) is not fixed to or suspended from the plate 26, but is arranged on or fixed onto or secured to a separating plate 56 separating the space 20 from the space 43. The legs 27 are replaced by a hollow, transparent contour 57 (typically a cylinder) surrounding the central zone 9 and arranged to fix the plate 26 to the plate 56 (for example plexiglass or glass 2 mm thick, 10 cm in diameter and 5 cm high). The plate 26 makes it possible to support two mirrors 58, 59 arranged to orient each light beam originating from the space 43 onto the rotating reflective surface 10. The main advantage is the creation of a continuous light plane or cone 19. The plate 26 and the cylinder 57 have a sufficiently large diameter so that an observer cannot directly view each non-spread beam, and so that if the device malfunctions, the beam can never reach the observer's eye without being spread.

Of course, the different features, forms, variants and embodiments of the invention can be combined together in various combinations insofar as they are not incompatible or mutually exclusive.

The invention claimed is:

1. A light device, comprising:

a.) at least one source arranged to emit a light beam;

b.) an optical system arranged to send said light beam from a central zone in several possible directions contained in a light cone, a vertex of which is located in the central zone, such that the light beam propagates in said light cone wherein the optical system comprises a reflective surface mounted rotatably in the center zone about the axis; and c.) a reflector system comprising at least one mirror mounted rotatably and/or mounted translatably relative to said central zone and arranged to receive the light beam propagating in said light cone and to reflect the received light beam in a space and outside said light cone.

2. The device according to claim 1, characterized in that said reflector system is arranged to move between several positions relative to said central zone such that a change of position changes the trajectory of a light beam reflected by the reflector system, the device also comprising a control system arranged to move the reflector system between said positions.

3. The device according to claim 2, characterized in that the reflector system is in the form of a polygon having several sides, each of its sides being formed by at least one mirror mounted rotatably about an axis.

4. The device according to claim 2, characterized in that the reflector system is mounted translatably.

5. The device according to claim 1, characterized in that the source comprises several sources, the light beam generated by each source having a colour different from the colours of the other light beams.

6. The device according to claim 1, characterized in that the light cone of the light beam is $2\pi$ steradians.

7. The device according to claim 1, characterized in that said reflective surface being arranged to reflect the light beam such that after reflection by the reflective surface, the light beam propagates in said light cone in a direction that depends on an angular position of the reflective surface about its axis.

8. The device according to claim 7, characterized in that it comprises control means arranged to control a rotation of the reflective surface about its axis at a rotation speed greater than a speed threshold and preferably constant, such that each source only emits its light beam when the reflective surface has reached a rotation speed greater than this speed threshold.

9. The device according to claim 7, characterized in that the reflective surface is mounted on a plate, such that the reflective surface is located between the plate and a space separate from the space in which the light beam received by the reflector system is reflected, this separate space containing the sources, the plate being fixed to the device by several legs.

10. The device according to claim 9, characterized in that the reflector system is in the form of a polygon having several sides, each of its sides being formed by at least one mirror mounted rotatably about an axis, and in that each leg is aligned with the central zone and with a connecting corner between two sides of the polygon.

11. The device according to claim 1, characterized in that it comprises the enclosed space, said enclosed space:

containing suspended elements arranged to diffuse the light of the light beam, or being equipped with an injector arranged to inject into the enclosed space suspended elements arranged to diffuse the light of the light beam.

12. The device according to the claim 11, characterized in that the enclosed space is delimited at least partially by transparent walls.

* * * * *